United States Patent [19]

Vandervaart

[11] Patent Number: 4,825,664

[45] Date of Patent: May 2, 1989

[54] HIGH EFFICIENCY HEAT EXCHANGER

[75] Inventor: Gerry Vandervaart, Niagara Falls, Canada

[73] Assignee: Kool-Fire Limited, Niagara Falls, Canada

[21] Appl. No.: 171,082

[22] Filed: Mar. 21, 1988

[51] Int. Cl.[4] ..... F25B 13/00

[52] U.S. Cl. ..... 62/324.1; 62/160; 62/324.6

[58] Field of Search ..... 62/324.1, 324.6, 160, 62/324.5, 278.7, 525; 165/29

[56] References Cited

U.S. PATENT DOCUMENTS

| | | | |
|---|---|---|---|
| 4,240,269 | 12/1980 | Bussjager | 62/324.6 |
| 4,311,191 | 1/1982 | Vandervaart | 62/324.5 |
| 4,311,192 | 1/1982 | Vandervaart | 62/324.5 |
| 4,399,664 | 8/1983 | Derosier | 62/238.7 |
| 4,407,137 | 10/1983 | Hayes, Jr. | 62/525 X |
| 4,430,864 | 2/1984 | Mathiprakasam | 62/324.1 X |
| 4,461,345 | 7/1984 | Vandervaart | 62/324.5 X |
| 4,625,524 | 12/1986 | Kimura et al. | 62/525 X |

*Primary Examiner*—Lloyd L. King

*Attorney, Agent, or Firm*—Diller, Ramik & Wight

[57] ABSTRACT

A heat exchanger which includes an outdoor coil, inlets and outlets for delivering and discharging refrigerant relative to the outdoor coil, the inlet being located above the outlet, main and auxiliary reversing/expansion valves, a compressor, an outdoor coil, associated lines and conduits between the latter components, and the main and auxiliary reversing valves being selectively operative to deliver the liquid and the vapor to the inlets in the respective heating and air conditioning modes.

36 Claims, 2 Drawing Sheets

HEAT PUMP
AND
HEAT AUGMENTED
MODE

Outdoor
Coil
Common
Outlet
Manifold
Common
Inlet
Manifold
Low
Pressure
Boiled-off
Vapour
Out
Liquid
In
Fan
Auxiliary
Reversing
Valve
Main
Reversing
Valve
Indoor
Coil
65
Compressor
64
Vapour

AIR CONDITIONING MODE

Outdoor Coil
Manifold
Manifold
High Pressure Discharge Vapour In
Liquid Out
Fan
Main Reversing Valve
Auxiliary Reversing Valve
Indoor Coil 65
Low Pressure Boiled-off Vapour
Compressor
High Pressure Discharge Vapour

HIGH EFFICIENCY HEAT EXCHANGER

BACKGROUND OF THE INVENTION

The present invention is related to an improved high efficiency heat exchanger of the type disclosed in U.S. Pat. Nos. 4,311,191 and 4,311,192, each issued on Jan. 19, 1982 in the name of Gerry Vandervaart and U.S. Pat. No. 4,461,345 issued on July 24, 1984, also in the name of Gerry Vandervaart. The contents of these three patents are incorporated herein by reference, particularly with respect to presently conventional structural and functional characteristics of such prior art heat exchangers.

U.S. Pat. Nos. 4,311,191 and 4,311,192 each disclose a heat exchanger which includes conventional components such as a compressor, indoor and outdoor coils, blowers associated with the coils, a reversing/expansion valve, and appropriate tubing or conduits such that the heat-exchange medium/refrigerant (Freon) can flow in opposite directions through associated conduits during air conditioning/cooling mode on the one hand and heating/heat-augmenting modes on the other. Traditionally, heat exchangers of the type disclosed in these patents only included reversible operation for cooling and heating modes, but in these patents in a heat-augmenting mode a gas burner directs flames against the outdoor A-coil as liquid refrigerant is introduced into the bottom thereof. The liquid refrigerant (Freon) absorbs the heat/Btu's which increases its temperature resulting in a vapor phase exiting the outdoor A-coil at its top which is subsequently transferred to the indoor coil and utilized with its associated blower to heat the interior of the building.

These conventional heat exchangers are extremely efficient up to approximately 5 tons, and this efficiency is attributed primarily to the fact that the outdoor A-coil is relatively short in height (20 inches high), the heat of the flame is generally intense and is "trapped" within the confines of the A-coil, and because the liquid refrigerant is introduced into the bottom of the A-coil which immediately absorbs a relatively great proportion of the BTU's at the lower end of the A-coil than at the upper end thereof which creates equalization of coil pressure/temperature and attendant liquid refrigerant to boiled-off vapor transfer.

Obviously, if one were to desire a higher capacity heat exchanger, one would expect that all need be done would be to increase the capacity of the outdoor A-coil by, for example, merely increasing its height (or its length) with other components being proportionately sized. However, there was no proportionate increase in efficiency found in actual practice when the conventional 20 inch high outdoor A-coil was replaced by a 36 inch high coil. Instead the efficiency of the heat pump in all modes of operation, but particularly the heat and heat-augmented modes of operation, was reduced. So long as the outdoor A-coil was relatively small and the flame was intense and generally trapped within the A-coil, except for its free flow through the coils of the legs thereof, the liquid refrigerant boiled-off generally uniformly, but as the temperature drops the refrigerant does not boil-off at the same rate of speed as the flow of the refrigerant through the tubing. Consequently, in the smaller sized outdoor A-coil of the patented system, the refrigerant at the bottom of the outdoor A-coil boils off from its liquid to its vapor state as it moves upwardly with relative uniformity and ease. However, in the larger outdoor A-coil there is insufficient liquid refrigerant to maximize boil-off. While an appropriate expansion device could be used to fill the tubing to such a point where it flows out the back into the compressor in a conventional manner, this failed to maintain necessary generally constant pressure/temperature throughout the outdoor A-coil, and particularly the two "legs" or sides thereof. The ability to maintain such pressure/-temperature balance substantially decreased in the large (36 inch high) outdoor A-coil. The liquid refrigerant in the larger outdoor A-coil tended more so to fill the colder side or leg of the outdoor A-coil (because of a lesser amount of air flow therethrough during the heat pump cycle), and as the burner flame came on, the easier path of travel for the heat is the side of the outdoor A-coil with the least amount of refrigerant therein. Thus, this automatically created an imbalance which likewise destroyed the heat transfer efficiency between the relatively intense gas flame and the liquid refrigerant. Quite simply, while in the smaller outdoor A-coil's heating and heat-augmented modes, the temperature and, therefore, the pressure of the refrigerant could be balanced throughout the outdoor A-coil it was relatively impossible to boil-off the liquid or refrigerant into its low pressure vapor state in both legs of the larger/higher outdoor a-coil.

SUMMARY OF THE INVENTION

The present invention solves the problem of maintaining high efficiency in a relatively large capacity heat exchanger and particularly one having a relatively large/high outdoor coil by maintaining uniform pressure and temperature throughout the coils of the outdoor coil, whether it is an A-coil or otherwise by (a) introducing liquid refrigerant into the top of the outdoor coil during the heat pump and heat-augmented modes of operation while still following conventional practice of introducing refrigerant vapor into the top of the outdoor coil in the air conditioning mode, (b) separating the outdoor coil into several stages, each having a separate refrigerant/vapor inlet and outlet, yet being connected to common inlet and outlet headers or manifolds (c) providing cross-over tubing between the legs of selected sections or stages of the outdoor coil, (d) utilizing gentle flames (relatively low BTU's output) at opposite legs of the outdoor A-coil and restricting the heat flow path by appropriate baffles, and (e) in addition to a main reversing/expansion valve which is conventional in heat exchangers of this type, providing an auxiliary reversing valve which effects appropriate refrigerant (liquid and/or vapor) flow in all three modes of operation of the heat exchanger.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
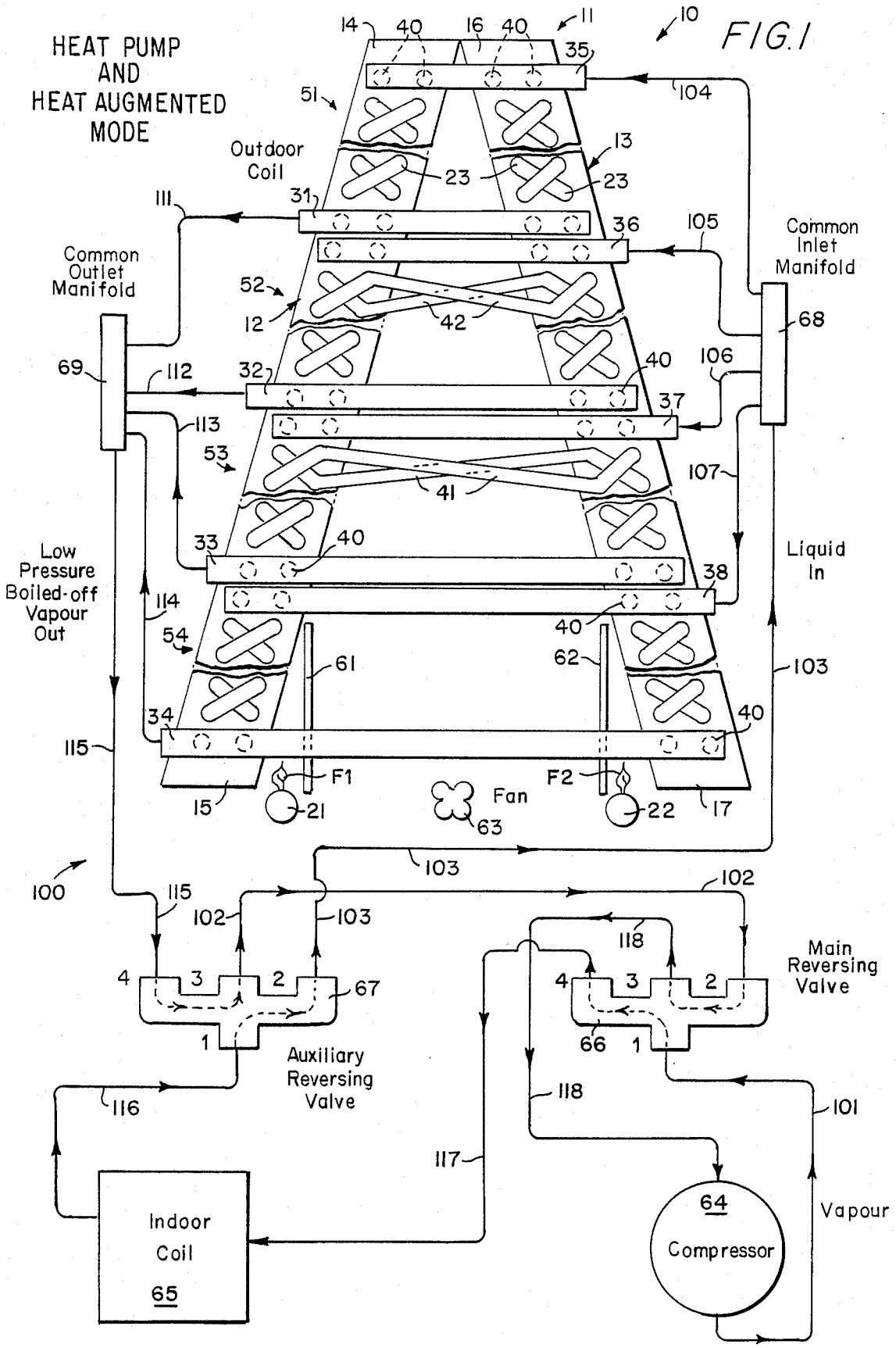
FIG. 1 is a schematic view of an overall heat exchanger of this invention, and illustrates an outdoor A-coil divided into four stages and including cross-over tubing between associated legs, auxiliary and main reversing valves, and an associated flow path of refrigerant/vapor in the heat pump and heat augmented modes of operation.
Figure 2:
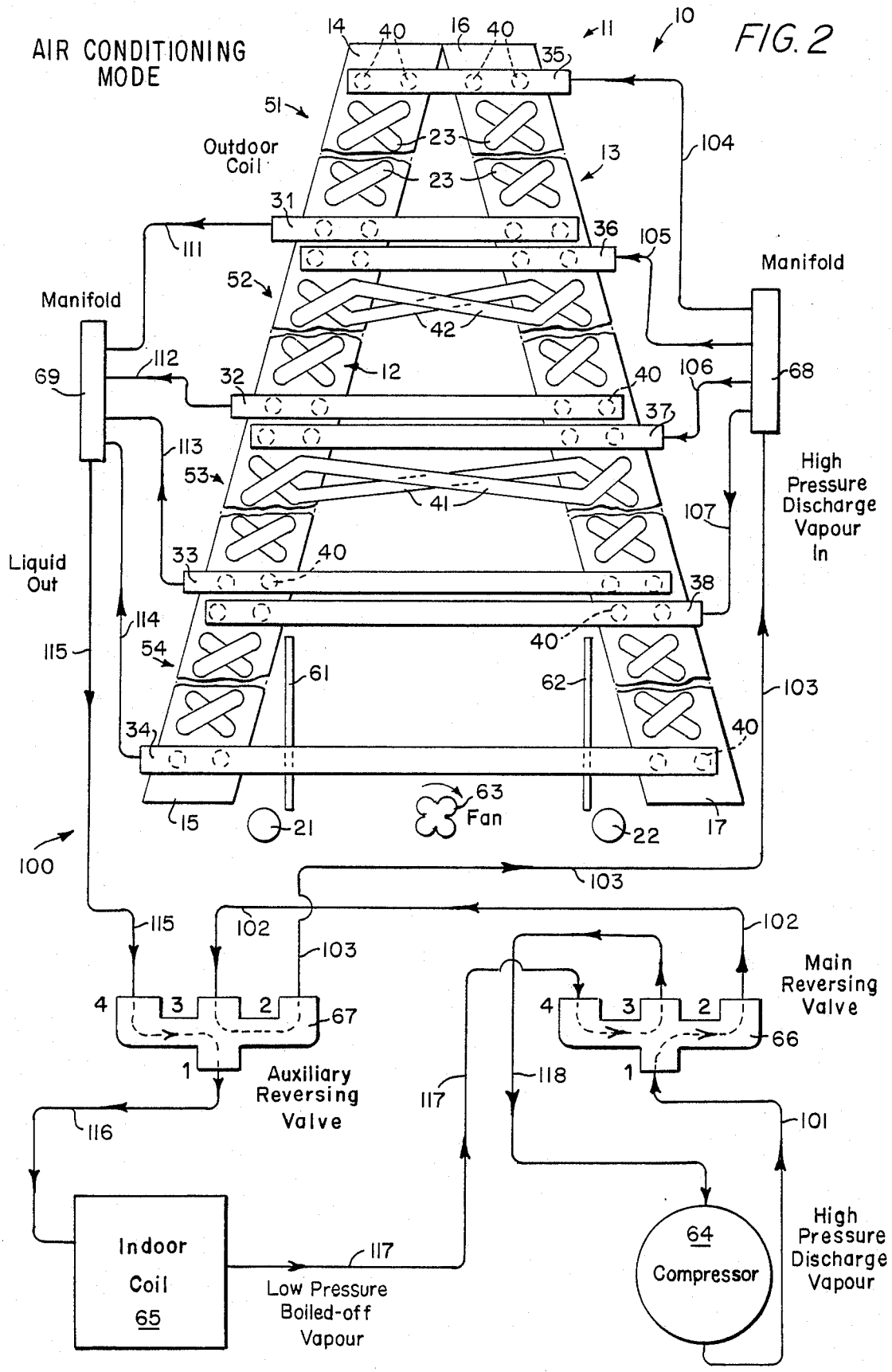
FIG. 2 is a schematic view similar to FIG. 1 of the heat exchanger of this invention, and illustrates the positions of the auxiliary and main reversing valves in the air conditioning mode of operation of the heat exchanger.

A novel heat exchanger or heat-exchange system constructed in accordance with this invention is illustrated in FIGS. 1 and 2 of the drawings and it generally designated by the reference numeral 10.

The heat exchanger 10 includes an outdoor coil 11 which is and A-coil of the type disclosed in the latter-identified patents and includes a pair of sides or legs 12, 13 having respective upper and lower ends or end portions 14, 15 and 16, 17, respectively. Though the ends 14, 16 of the respective legs 12, 13 are shown quite close to each other, in actual practice these ends are spaced from each other and are not closed by, for example, a plate or the like corresponding to the plate 37 of U.S. Pat. Nos. 4,311,191 and 4,311,192. Thus, heat which rises as a result of flames F1, F2 (FIG. 1) issuing from gas burners 21, 22, respectively, in the heat-augmented mode of operation of the heat exchanger 11, which will be described more fully hereinafter, rises upwardly under the conventional chimney effect and the BTU's are absorbed by liquid heat-exchange medium or refrigerant (Freon) flowing through conventional coil tubing 23 of the legs 12, 13.

The outdoor A-coil 11 includes four heat-exchange medium outlet headers 31 through 34 and four heat-exchange medium inlet headers 35 through 38. The inlet and outlet headers are arranged in header pairs 31, 35; 32, 36; 33, 37; and 34, 38. Each of the headers 31 through 38 are in fluid communication with the coil tubing 23 of both legs 12, 13 through appropriate pieces of short tubing, each identified by reference numeral 40. As is readily apparent from FIGS. 1 and 2, whether liquid refrigerant (FIG. 1) or vapor (FIG. 2) enters the inlet headers 35 through 38, it flows into the coil tubing 23, downwardly therethrough, and exits the respective outlet headers 31 through 34. In this manner, the A-coil 11 is effectively divided into four sections 51 through 54, each having its respective inlet and outlet header, namely, the section 51 being defined by and between the headers 31, 35; the section 52 being set-off and defined by and between the headers 32 and 36 and the coil tubing 23 therebetween, etc. By virtue of the different sections 52 through 54, it is readily apparent that though the total height of the A-coil 11 might be 36 inches, each section is effectively an independent coil of a height approximately 9 inches (36" height$\neq$4 sections=9").

Selective ones of the sections 51 through 54 are also provided with cross-over tubing 41, 42, for example, placing the coil tubing 23 of the legs 12, 13 in fluid communication with each other across the sections 52, 53. The cross-over tubing 41, 42 also augments pressure/temperature balancing within the coil tubing 23 of both legs 12, 13 but also functions otherwise in the operation of the heat exchanger 10, as will also be described more fully hereinafter.

It is to be noted that the number of coils of the coil tubing 23 per leg 12, 13 or per section 51 through 54 has merely been illustrated schematically in FIG. 1 and is, obviously, not representative of an actual working embodiment of the outdoor A-coil 11. For example, in a working embodiment of the outdoor A-coil 11, each side or leg 12, 13 is, as heretofore noted, approximately 36 inches high and approximately 24 inches long having a thickness of approximately 1½ inches. There are also two crossed rows (or four rows) of 36 tubes in each leg 12, 13 which amounts to approximately 144 tubes per leg or 36 tubes per section 51 through 54.

Internally of the outdoor A-coil 11 adjacent the lower ends 15, 17 is a respective baffle or plate 61, 62. The baffles 61, 62 and the burners 21, 22 extend the length of the A-coil and tend to confine the flames F1, F2, respectively, toward the coil tubing 23 of the lowermost section 54 before exiting beyond the upper ends (unnumbered) of the baffles 61, 62.

A fan or blower 63 is operative during the heat pump mode and the air conditioning mode of operation at which time the burners 21, 22 are inoperative, as is more fully described in the latter-noted patents.

The heat exchanger 10 also includes a conventional compressor 64, an indoor coil 65 and a main reversing-/expansion valve 66. However, the main reversing valve 66 is operative in conjunction with an auxiliary reversing/expansion valve 67 to assure that during the heat pump and heat-augmented modes of operation (FIG. 1) heat-exchange medium/refrigerant in liquid state will be introduced into the inlet headers 35 through 38 and in the air conditioning mode (FIG. 2) refrigerant in its vapor state will be introduced into the same inlet headers 35 through 38. In all three modes of operation the flow of the heat exchange medium, whether in liuid or vapor form, will be downwardly exiting the sections 51 through 54 through the outlet headers 31 through 34, respectively. In order to further assure a balance of pressure and temperature in all three modes, the inlet headers 35 through 38 are connected to a common inlet manifold 68 while the outlet headers 31 through 34 are connected to a common outlet manifold 69 over lies, conduits or tubing, all collectively identified by the reference numeral 100, but individual lines, pipes or tubing thereof will be individually numbered immediately hereinafter in describing the varous modes of operation of the heat exchanger 11.

OPERATION

Reference is made first to FIG. 2 which illustrates the positions of the auxiliary reversing valve 67 and the main reversing valve 66 in the air conditioning mode of operation of the heat exchanger 10. This mode of operation is selected first for description because it corresponds generally to the conventional flow of liquid refrigerant and vapor during the air conditioning mode of operation of conventional heat pumps, including those of the patents noted herein in which the high pressure vapor discharged from the compressor is introduced into the A-coils at the top thereof. In the air conditioning mode of the heat exchanger 10, the fan or blower 63 is, of course, operative and rotating, as indicated by the unnumbered headed arrow associated therewith in FIG. 2 to drive ambient air through the outdoor coil 11 and specifically through the coil tubing 23 thereof. Furthermore, as noted earlier, the burners 21, 22 are not energized, a blower (not shown) associated with the indoor coil 65 is operative and the compressor 64 is energized.

As is customary in the air conditioning/cooling mode of operation of the heat exchanger 10, the compressor 64 delivers high pressure hot vapor refrigerant to the outdoor A-coil 10 through a conduit or line 101, the "1" inlet port of the main reversing valve 66, the "2" outlet port of the main reversing valve 66, a line 102 into the "3" inlet port of the auxiliary reversing valve 67, out through the "2" outlet port of the auxiliary reversing valve 67, a line 103 into the common inlet manifold 68 and through lines 104 through 107 into the respective inlet headers 35 through 38. The high pressure discharge refrigerant in its vapor state travels downwardly through the coil tubing 23 of each of the sections 51 through 54 and exits therefrom through the outlet headers 31 through 34, and as the high pressure hot vapor refrigerant is pumped downwardly through the coil tubing 23, it gives off its heat to the air flowing therethrough under the influence of the fan or blower 63 and is transformed into its cooler liquid phase discharging from the outlet headers 31 through 34 over respective lines 111 through 114 into the common outlet manifold 69. Since the inlet manifold 68 is common to each of the lines 104 through 107, pressure/temperature of the vapor entering the coil tubing 23 in each of the inlet headers 35 through 38 is essentially identical and remains so until discharged with any tendency in variation being offset by the cross-over lines or tubing 41, 42, of the sections 52, 53, or as might otherwise be provided or needed relative to the sections 51, 54. The coil liquid refrigerant exits the common outlet manifold 69 over a line 115, enters the "4" inlet port of the auxiliary reversing valve 67, exits the "1" outlet port of the auxiliary reversing valve 67 and enters the indoor coil over a line 116. The fan or blower (not shown) associated with the indoor coil 65 blows air through the coil 65 which picks-up or absorbs the heat blown therethrough cooling this air which in turn cools the room or building and transforms the liquid phase into low pressure boiled-off vapor with exits the indoor coil 65 over a line 117, enters the "4" inlet port of the main reversing valve 66, exits the "3" outlet port of the main reversing valve 66 and is directed by a line 118 back to the compressor 64, thus completing its circuit.

It is to be particularly noted that in the operation of the air conditioning mode of the heat exchanger 10 the high pressure vapor enters each of the inlet headers 35 through 38 at the top of each of the sections 51 through 54 and exits the same sections at the bottom thereof through the respective headers 31 through 34. This is particularly important because it permits total utilization of the entire area of the coil tubing 23 to cool the vapor as it flows downwardly and thereby efficiently transforms the same to the exiting liquid state. This is traditional common practice in conventional heat pumps, including those of the patents noted therein, and in such systems when the mode of operation is reversed to the heat pump mode, the liquid enters the outdoor coil through the bottom and flows upwardlly, but such is not the case in the present invention, as will be noted immediately hereinafter.

Reference is now made to FIG. 1 of the drawings which illustrates the circulation of the liquid and vapor phases of the refrigerant when the heat exchanger 10 is operating in both the heat pump and the heat-augmented modes of operation. In the heat pump mode of operation the burners 21, 22 are not ignited and the fan 63 is energized, whereas in the heat augmented mode the burners 21, 22 are ignited resulting in the flames F1, F2 and the fan or blower 63 is not energized. Accordingly, in recognizing these differences only the heat-augmented mode of operation will be described immediately hereinafter.

In the heat augmented mode of operation of the heat exchanger 10, as depicted in FIG. 1, the fan or blower 63 is inoperative and the flame F1, F2 rise upwardly from the respective burners 21, 22 immediately adjacent the lower ends 15, 17, respectively, of the legs 12, 13, respectively, of the outdoor A-coil 11. In the outdoor coil of the noted patents, a single centrally located burner having a relatively intense/high temperature flame was utilized, but the problem discovered was that the flame tended to "float" upwardly through the middle of the A-coil and resisted passing into and through the coil tubing. Moreover, in the outdoor A-coil of the patents, the flame was still very hot at the top of the outdoor A-coil, vaporized liquid thereat increasing its pressure, and the pressure at the top of the coil resisted the upward movement of the liquid refrigerant with the result that heat simply escaped the outdoor coil through the top without being efficiently absorbed.

In the present invention these disadvantages have been overcome by utilizing two burners 21, 22 extending generally the entire length (24") of the A-coil legs 12, 13 and utilizing the baffles 61, 62 to direct the correspondingly gentler flames F1, F2 and lower BTU's thereof in a direction of confinement relative to the coil tubing 23 of the lower section 54. The baffles 61, 62 are spaced approximately ½ inch away from the coil tubing 23 and the coil section 54 and, thus, the flames F1, F2 cannot go toward the middle of the coil but are reflected or directed against the coil tubing 23 of both legs 12, 13. As will be described hereinafter relative to the refrigerant/vapor flow, the liquid refrigerant in the bottom section 54 begins to pick-up or absorb heat from the flames F1, F2, but all of the heat is not picked-up and some will, obviously, escape into the next section 53 but with less intensity (BTU's). Since the intensity has increased, the tendency of the heat to flow toward the middle of the coil in a chimney effect is lessened and the heat from both flames F1, F2 tends to reflect or bounce along the coil tubing 23 upwardly through the remaining successive sections 53 through 51 exiting in essentially a depleted state through the space between the upper ends 14, 16 of the coil legs 12, 13. At the very top of the A-coil 11 there is insufficient heat to blow back the liquid refrigerant thereby maintaining generally equal pressure and temperature throughout the entirety of the A-coil 11 and each of the four sections 51 through 54 thereof. It should be particularly noted that the liquid refrigerant travels downwardly only approximately 9 inches through each section 51 through 54 and, therefore, though the overall coil height is 36", the disadvantages heretofore noted in a coil of this height having but a single upper liquid refrigerant inlet header and a single pressurized vapor outlet header are entirely avoided.

It is also pointed out that prior to the operation of the heat-augmented mode at a temperature range of approximately 32° F. −45° F., the heat exchanger 10 operates only in the heat pump mode since at temperatures above 45° F., ambient air has sufficient Btu's for heating. Assuming, therefore, that the heat exchanger 10 was operating in its heat pump mode, ambient temperature fell below 45° F., the fan 63 would cut-off, and the burners 21, 22 would ignite. However, if during a pause between these modes ambient temperature outdoors causes the refrigerant in one leg or the other to become warmer, when the burners 21, 22 ignite, the tendency is for the heat to migrate toward the warmer side of the coil tubing 23 and escape. However, this is prevented by the cross-over tubing 41, 42 which balances the temperature/pressure across the sections 52, 53 and, of course, wherever else deemed necessary in the remaining sections 51, 54 by providing like cross-over tubing therein (not shown). (In the air conditioning mode this problem is not severe because of the higher pressures involved and the higher velocity of the refrigerant moving through the circuit 100, but at the lower velocities in the heat pump mode the problem could occur when the refrigerant is boiling-off.)

It is also to be noted that the vapor exiting each of the outlet headers 31 through 34 is essentially of the same pressure/temperature, but any remaining minor variations are fully equalized in the common outlet manifold 69.

Another important aspect of the introduction of the liquid refrigerant into the top of each coil section 51 through 54 is the ability of the heat exchanger 10 to maintain a defrost capability in the absence of a defrost (reversing) cycle, as is conventionally practiced, though not in the prior structures noted in the patents herein. Assuming, for example, that the A-coil 11 is frosted at the top because of the colder liquid refrigerant introduced thereat (or at each stage 51 through 54). There is, obviously, a need to defrost the A-coil 11, yet, as noted earlier, there is little, if any, heat or Btu's remaining as the heated air from the flames F1, F2 exits the opening between the open top ends 14, 16 of the A-coil 11. However, by increasing the pressure of the refrigerant, its temperature will increase and the A-coil 11 will defrost. Assuming that the pressure of the refrigerant is 60 pounds, this is generally the equivalent of a temperature of 30° F. Therefore, if the pressure in any section 51 through 54 is reaised to 62 pounds, the coil temperature increases to 32° F., etc. Therefore, by allowing the refrigerant at the bottom section 54 to increase in pressure because of the higher temperature from the flames F1, F2, the pressure at the top section 51 of the coil 11 will be the same pressure as at the bottom section 54 because of the common manifold connections at 68, 69 therebetween. Consequently, the top of the A-coil 11 will essentially defrost under pressure even though there are essentially little BTU's exiting the top of the A-coil 11.

With the foregoing in mind the porting of the main reversing/expansion valve 66 and the auxiliary reversing/expansion valve 67 is changed from the air conditioning mode (FIG. 2) to the heat-augmented mode or heat pump mode in the manner illustrated in FIG. 1 to effectively deliver the refrigerant in its liquid phase to the tops of the outdoor A-coil sections 51 through 54 through the associated respective inlet headers 35 through 38 along the flow path defined by the various lines of the refrigerant circuit 100 in the following manner recognizing, once again, that in this mode the fan 63 is inoperative and the heat of the flames F1, F2 rising in the manner described in the manner described earlier boils-off the liquid refrigerant as it descends downwardly through the coil tubing 23 of each section 51 through 54 and thereby transforms the same into its boiled-off low pressure vapor state which exits the respectively outlet headers 31 through 34 which in turn are connected to the common outlet manifold 69 by the respective lines 111 through 114. The essentially equal pressure/temperature of the vapor phase of the refrigerant delivered by the individual lines 111 through 114 into the common outlet manifold 69 is virtually assured to be maintained equal simply by the commonality of the manifold 69 to these lines. Thereafter, the vapor follows a flow path defined by the line 115, the "4" inlet port of the auxiliary reversing valve 67, the "3" outlet port of the auxiliary reversing valve 67, the line 102, the "2" inlet port of the main reversing valve 66, the "3" outlet port of the auxiliary reversing valve line 118 to the compressor 64. High pressure vapor leaves the compressor 64 over the line 101 and travels to the "1" inlet port OF THE MAIN REVERSING VALVE §§, EXITS THE MAIN REVERSING VALVE §§ THROUGH THE "4" outlet port, and is introduced into the indoor coil 65 over the line 117. The blower or fan (not shown) of the indoor coil 65 is, of course, operative and as the hot vapor phase of the refrigerant flows through the indoor coil 65, the air blown through the indoor coil 65 absorbs the heat of the vapor phase refrigerant and heats the interior of the associated room, building, dwelling, etc. As the refrigerant progressively cools to its liquid phase, it is returned by the line 116 through the auxiliary reversing/expansion valve 67 through the "1" inlet port thereof, exits the auxiliary reversing valve 67 through the "2" outlet port and is delivered by the line 103 to the common inlet manifold 68. The cool refrigerant in its liquid state is then delivered by the lines 104 through 107 from the manifold 68 into the respective inlet headers 35 through 38 thereby completing the refrigerant circuit.

Thus, by the addition of the auxiliary reversing/expansion valve 67, the liquid refrigerant is introduced into the top of the A-coil 11 and the sections 51 through 54 thereof thereby efficiently picking-up the heat/BTU's from the flames F1, F2 as the lqiuid flows downwardly, becomes warm, and as the coil tubing 23 warms progressively, it draws more heat/BTU's which flows to the warmer sections of the coil tubing 23 AND in turn prevents the liquid refrigerant from boiling-off. Thus, there is obtained maximum saturation, maximum flow and maximum efficiency with equalization of temperature and pressure throughout all of the coil sections 51 through 54.

The heat exchanger 10 of FIGS. 1 and 2 is sized for houses of average size, but for commercial applications the heat exchanger 10 can be modified with ease to increase its output capacity as follows. A second outdoor A-coil identical to the A-coil 11 and including a fan 63, burners 22, 23 and baffles 61, 62 is mounted adjacent and in side-by-side relationship to the outdoor A-coil 11. This can be readily visualized by placing FIG. 1 to the left of and in generally side-by-side relationship to FIG. 2. The inlet headers 35 through 38 of both A-coils are connected to each other as are the outlet headers 31 through 34. Next, instead of the cross-over tubing 41, 42 being connected between the legs 12, 13 of each outdoor A-coil 11, the cross-overs are connected between the adjacent A-coils and there is not one but instead two cross-over tubes in whatever sections such cross-over tubing is required. For example, assuming that in the commercial double A-coil arrangement the cross-over tubing will also be between the sections 52, 52 and 53, 53 of adjacent A-coils, one pair of cross-over tubing will be connected between the most remote (outermost) legs of the A-coils and the other cross-over tubing in the same section will be connected to the nearest most adjacent legs of the associated section. For example, visualizing the A-coils 11 of FIGS. 1 and 2 in side-by-side relationship with FIG. 2 to the right, as earlier noted, one set of cross-over tubing would connect the coil tubing 23 of the coil section 52 of the leg 12 of FIG. 1 with the coil tubing 23 of the leg 13 of the section 52 of FIG. 2 (corresponding to cross-overs between the furthest legs of the two adjacent A-coils). The other cross-over tubing of the sections 52 would connect the coil tubing 23 of the leg 13 of the section 52 of the A-coil of FIG. 1 to the coil tubing 23 of the leg 12 of the section 52 of FIG. 2 (corresponding to cross-overs between the nearest legs of the two adjacent A-coils).

In the example just given, and assuming that FIG. 2 is again to the right of FIG. 1, the liquid refrigerant entering the lines 104 through 107 in the heat-augmented mode (or heat pump mode) would enter the inlet headers 35 through 38 are not only flow downwardly in FIG. 2 (which in this assumed condition is not, of course, in the air conditioning mode), and would flow downwardly and also continue to the inlet headers 35 through 38 of FIG. 1 to flow downwardly therein. Obviously, the same discharge of vapor would occur, namely, out of the outlet headers 31 through 34 of FIG. 2 through the same headers of FIG. 1 and the lines 111 and 114 to the common outlet manifold 69. Obviously, the modified cross-over tubing between the innermost and outermost legs of the two adjacent outdoor A-coils would function as described earlier with respect to FIGS. 1 and 2. Accordingly, by this simple modification of essentially tying together two A-coils in a parallel refrigerant circuit, the output capacity is increased without any decrease in overall deficiency. Obviously, changes in indoor coil sizes, blower speeds, and/or compressor sizes may be necessitated for relatively larger commercial units when, for example, instead of two A-outdoor coils being connected together three, four or more may be so connected and utilized.

Although a preferred embodiment of the invention has been specifically illustrated and described herein, it is to be understood that minor variations may be made in the apparatus without departing from the spirit and scope of the invention, as defined in the appended claims.

I claim:

1. A heat exchanger comprising an outdoor coil for circulating therethrough a heat-exchange medium, an inlet for delivering a heat-exchange medium into said outdoor coil, an outlet for discharging the heat-exchange medium for said outdoor coil, said inlet being located above said outlet; main reversing valve means, auxiliary reversing valve means, a compressor, and an indoor coil; conduit means for placing said indoor coil, outdoor coil, compressor, auxiliary reversing valve means and main reversing valve means in fluid communication with each other in heating and air conditioning modes of operation of said heat exchanger; and said main and auxiliary reversing valve means being selectively operative in the heating mode to deliver the heat-exchange medium in a liquid state to said inlet and in the air conditioning mode to deliver the heat-exchange medium in vapor state to said inlet.

2. The heat exchanger as defined in claim 1 wherein a high pressure outlet of said compressor is placed in fluid communication with said outdoor coil inlet in said air conditioning mode whereby the vapor state of the heat-exchange medium is pressurized.

3. The heat exchanger as defined in claim 1 wherein a liquid outlet of said indoor coil is placed in fluid communication with said outdoor coil inlet in said heating mode whereby the liquid state of the heat-exchange medium is delivered to said outdoor coil inlet in the heating mode.

4. The heat exchanger as defined in claim 1 including means for heating the heat-exchange medium as it passes through said outdoor coil.

5. The heat exchanger as defined in claim 1 wherein said outdoor coil is of a generally inverted V-shaped configuration.

6. The heat exchanger as defined in claim 1 wherein said outdoor coil is of a generally inverted V-shaped configuration defined by two upwardly converging coils having upper and lower coil portions, and means at each lower coil portion for heating the heat-exchange medium as it passes through each lower coil portion.

7. The heat exchanger as defined in claim 1 wherein said outdoor coil is of a generally inverted V-shaped configuration defined by two upwardly converging coils having upper and lower coil portions, means at each lower coil portion for heating the heat-exchange medium as it passes through each lower coil portion, and means at each lower coil portion for generally confining the heat generated by said heating means at said lower coil portions and generally blocking inward migration of the generated heat.

8. The heat exchanger as defined in claim 1 wherein said outdoor coil is of a generally inverted V-shaped configuration defined by two upwardly converging coils having upper and lower coil portions, means at each lower coil portion for heating the heat-exchange medium as it passes through each lower coil portion, means at each lower coil portion for generally confining the heat generated by said heating means at said lower coil portions and generally blocking inward migration of the generated heat, said confining means includes a baffle adjacent each lower coil portion, and said heating means are positioned to direct the generated heat between each baffle and an adjacent lower coil portion.

9. The heat exchanger as defined in claim 1 wherein said outdoor coil includes at least two coil portions in spaced relationship to each other, said two coil portions include upper and lower ends, said inlet and said outlet being connected to said respective upper and lower ends, and cross-over tubes between and in fluid communication with said two coil portions between said inlet and outlet.

10. The heat exchanger as defined in claim 1 wherein the heating mode said main and auxiliary reversing valves are positioned to define a heat-exchange medium flow path which successively includes from said outdoor coil outlet said auxiliary reversing valve means, said main reversing valve means, said compressor, said main reversing valve means, said indoor coil, said auxiliary reversing valve means and said outdoor coil inlet.

11. The heat exchanger as defined in claim 1 wherein in the air conditioning mode said main and auxiliary reversing valves are positined to define a heat-exchange medium flow path which successively includes from said outdoor coil outlet said auxiliary reversing valve means, said indoor coil, said main reversing valve means, said compressor, said main reversing valve means, said auxiliary reversing valve means and said outdoor coil inlet.

12. The heat exchanger as defined in claim 1 wherein in the heating mode said main and auxiliary reversing valves are positioned to define a heat-exchange medium flow path which successively includes from said outdoor coil outlet said auxiliary reversing valve means, said main reversing valve means, said compressor, said main reversing valve means, said indoor coil, said auxiliary reversing valve means and said outdoor coil inlet, and in the air conditioning mode said main and auxiliary reversing valves are positioned to define a heat-exchange medium flow path which successively includes from said outdoor coil outlet said auxiliary reversing valve means, said indoor coil, said main reversing valve means, said compressor, said main reversing valve means, said auxiliary reversing valve means, said auxiliary reversing valve means and said outdoor coil inlet.

13. The heat exchanger as defined in claim 2 wherein a liquid outlet of said indoor coil is placed in fluid communication with said outdoor coil inlet in said heating mode whereby the liquid state of the heat-exchange medium is delivered to said outdoor coil inlet in the heating mode.

14. The heat exchanger as defined in claim 13 including means for heating the heat-exchange medium as its passes through said outdoor coil.

15. The heat exchanger as defined in claim 13 wherein said outdoor coil is of a generally inverted V-shaped configuration.

16. The heat exchanger as defined in claim 13 wherein said outdoor coil is of a generally inverted V-shaped configuration defined by two upwardly converging coils having upper and lower coil portions, and means at each lower coil portion for heating the heat-exchange medium as it passes through each lower coil portion.

17. The heat exchanger as defined in claim 13 wherein the heating mode said main and auxiliary reversing valves are positioned to define a heat-exchange medium flow path which successively includes from said outdoor coil outlet said auxiliary reversing valve means, said main reversing valve means, said compressor, said main reversing valve means, said indoor coil, said auxiliary reversing valve means and said outdoor coil inlet. —

18. The heat exchanger as defined in claim 13 wherein in the air conditioning mode said main and auxiliary reversing valves are positioned to define a heat-exchange medium flow path which successively includes from said outdoor coil outlet said auxiliary reversing valve means, said indoor coil, said main reversing valve means, said compressor, said main reversing valve means, said auxiliary reversing valve means and said outdoor coil inlet.

19. The heat exchanger as defined in claim 12 wherein in the heating mode said main and auxiliary reversing valves are positioned to define a heat-exchange medium flow path which successively includes from said outdoor coil outlet said auxiliary reversing valve means, said main reversing valve means, said compressor, said main reversing valve means, said indoor coil, said auxiliary reversing valve means and said outdoor coil inlet, and in the air conditioning mode said main and auxiliary reversing valves are positioned to define a heat-exchange medium flow path which successively includes from said outdoor coil outlet said auxiliary reversing valve means, said indoor coil, said main reversing valve means, said compressor, said main reversing valve means, said auxiliary reversing valve means, said auxiliary reversing valve means and said outdoor coil inlet.

20. A heat exchanger comprising an outdoor coil for circulating therethrough a heat-exchange medium said outdoor coil having upper and lower ends, a pluraltiy of pairs of heat-exchange medium inlets and outlets in fluid communication with said outdoor coil for respectively delivering the heat-exchange medium into and discharging the heat-exchange medium from said outdoor coil, each inlet being located above the outlet of each pair of inlets and outlets and defining with coil portions of the outdoor coil therebetween individual coil sections of said outdoor coil, a common inlet line and a common outlet line in fluid communication with said respective inlets and outlets; main reversing valve means, auxiliary reversing valve means, a compressor and an indoor coil; conduit means for placing said common inlet and outlet lines, indoor coil, compressor, auxiliary reversing valve means and main reversing valve means in fluid communication with each other in heating and air conditioning modes of operation of said heat exchanger; and said main and auxiliary reversing valve means being selectively operative in the heating mode to deliver the heat-exchange medium in liquid state to said common inlet line and in the air conditioning mode to deliver the heat-exchange medium in the vapor state to said common outlet line.

21. The heat exchanger as defined in claim 20 wherein a high pressure outlet of said compressor is placed in fluid communication which said common inlet line in said air conditioning mode whereby the vapor state of the heat-exchange medium is pressurized.

22. The heat exchanger as defined in claim 20 wherein a liquid outlet of said indoor coil is placed in fluid communication with said common inlet line in said heating mode whereby the liquid state of the heat-exchange medium is delivered to said outdoor coil inlet in the heating mode.

23. The heat exchanger as defined in claim 20 including means for heating the heat-exchange medium as its passes through said outdoor coil.

24. The heat exchanger as defined in claim 20 wherein said outdoor coil is of a generally inverted V-shaped configuration.

25. The heat exchanger as defined in claim 20 wherein said outdoor coil is of a generally inverted V-shaped configuration defined by two upwardly converging coils having upper and lower coil portions, and means at each lower coil portion for heating the heat-exchange medium as it passes through each lower coil portion.

26. The heat exchanger as defined in claim 20 wherein said outdoor coil is of a generally inverted V-shaped configuration defined by two upwardly converging coils having upper and lower coil portions, means at each lower coil portion for heating the heat-exchange medium as it passes through each lower coil portion, and means at each lower coil portion for generally confining the heat generated by said heating means at said lower coil portions and generally blocking inward migration of the generated heat.

27. The heat exchanger as defined in claim 20 wherein said outdoor coil is of a generally inverted V-shaped configuration defined by two upwardly converging coils having upper and lower coil portions, means at each lower coil portion for heating the heat-exchange medium as it passes through each lower coil portion, means at each lower coil portion for generally confining the heat generated by said heating means at said lower coil portions and generally blocking inward migration of the generated heat, said confining means includes a baffle adjacent each lower coil portion, and said heating means are positioned to direct the generated heat between each baffle and an adjacent lower coil portion.

28. A heat exchanger comprising first and second outdoor coils for circulating therethrough a heat-exchange medium, said first and second outdoor coils each having upper and lower ends, a plurality of pairs of heat-exchange medium inlets and outlets in fluid communication with said first and second outdoor coils for respectively delivering the heat-exchange medium into and discharging the heat-exchange medium from said first and second outdoor coils, each inlet being located above the outlet of each pair of inlets and outlets and defining with coil portions of the first and second outdoor coils therebetween individual coil sections of said first and second outdoor coils, crossover conduit means in fluid communication between common coil sections of said first and second outdoor coils, a common inlet line and a common outlet line in fluid communication with said respective inlets and outlets; main reversing valve means, auxiliary reversing valve means, a compressor and an indoor coil; conduit means for placing said common inlet and outlet lines, indoor coil, compressor, auxiliary reversing valve means and main reversing valve means in fluid communication with each other in heating and air conditioning modes of operation of said heat exchanger; and said main and auxiliary reversing valve means being selectively operative in the heating mode to deliver the heat-exchange medium in liquid state to said common inlet line and in the air conditioning mode to deliver the heat-exchange medium in the vapor state to said common outlet line.

29. The heat exchanger as defined in claim 28 wherein a high pressure outlet of said compressor is placed in fluid communication which said common inlet line in said air conditioning mode whereby the vapor state of the heat-exchange medium is pressurized.

30. The heat exchanger as defined in claim 28 wherein a liquid outlet of said indoor coil is placed in fluid communication with said common inlet line in said heating mode whereby the liquid state of the heat-exchange medium is delivered to said outdoor coil inlet in the heating mode.

31. The heat exchanger as defined in claim 28 including means for heating the heat-exchange medium as it passes through said first and second outdoor coils.

32. The heat exchanger as defined in claim 28 wherein said first and second outdoor coils define a generally inverted V-shaped configuration.

33. The heat exchanger as defined in claim 28 wherein said first and second outdoor coils define a generally inverted V-shaped configuration, and means at said outdoor coils lower end for heating the heat-exchange medium as it passes through said first and second coils.

34. The heat exchanger as defined in claim 28 wherein said first and second outdoor coils define a generally inverted V-shaped configuration, means at said outdoor coils lower ends for heating the heat-exchange medium as it passes through said first and second coils, and means at each coil lower end for generally confining the heat generated by said heating means at said coil lower ends and generally blocking inward migration of the generated heat.

35. The heat exchanger as defined in claim 28 wherein said first and second outdoor coils define a generally inverted V-shaped configuration, means at said outdoor coils lower ends for heating the heat-exchange medium as it passes through said first and second coils, means at each coil lower end for generally confining the heat generated by said heating means at said coil lower ends and generally blocking inward migration of the generated heat, said confining means includes a baffle adjacent each coil lower end, and said heating means are positioned to direct the generated heat between each baffle and an adjacent coil lower end.

36. The heat exchanger as defined in claim 28 wherein said crossover conduit means are a pair of crossed tubes connected at opposite ends to a respective one of said first and second outdoor coils coil sections.

* * * * *